US009463499B2

(12) United States Patent
Nakashima et al.

(10) Patent No.: US 9,463,499 B2
(45) Date of Patent: Oct. 11, 2016

(54) APPARATUS FOR CORRECTING DEFORMATION OF REACTION VESSEL AND METHOD FOR CORRECTING DEFORMATION THEREFOR

(71) Applicant: TOHO TITANIUM CO., LTD., Chigasaki-shi, Kanagawa (JP)

(72) Inventors: Satoru Nakashima, Chigasaki (JP); Tarou Tomita, Chigasaki (JP); Atsushi Sakagami, Chigasaki (JP)

(73) Assignee: TOHO TITANIUM CO., LTD., Kanagawa (JP)

( * ) Notice: Subject to any disclaimer, the term of this patent is extended or adjusted under 35 U.S.C. 154(b) by 109 days.

(21) Appl. No.: 14/162,790

(22) Filed: Jan. 24, 2014

(65) Prior Publication Data

US 2014/0208816 A1 Jul. 31, 2014

(30) Foreign Application Priority Data

Jan. 25, 2013 (JP) ..... 2013-012014

(51) Int. Cl.

*B21D 3/14* (2006.01)
*B21D 31/04* (2006.01)
*B21D 41/02* (2006.01)

(52) U.S. Cl.

CPC ..... *B21D 3/14* (2013.01); *B21D 31/04* (2013.01); *B21D 41/02* (2013.01)

(58) Field of Classification Search

CPC .... B21D 39/20; B21D 39/06; B21D 41/026; B21D 1/08; B21D 22/025; B21D 41/028; Y10T 29/4994; Y10T 29/53722; Y10T 29/49938; Y10T 29/53122; Y10T 29/53987; B23P 9/025; B21C 37/30; B21C 47/30

See application file for complete search history.

(56) References Cited

U.S. PATENT DOCUMENTS

| | | | | |
|---|---|---|---|---|
| 5,737,957 A * | 4/1998 | Gray | 72/342.94 |
| 8,523,099 B2 * | 9/2013 | Kipping | 242/571 |
| 2005/0126252 A1 * | 6/2005 | Feldmann | B21D 3/00 72/393 |

FOREIGN PATENT DOCUMENTS

| | | | |
|---|---|---|---|
| JP | 5-212443 A | | 8/1993 |
| JP | 05212443 A | * | 8/1993 |
| JP | 2001-038421 A | | 2/2001 |

OTHER PUBLICATIONS

Machine translations of JP05212443A from J-PlatPat of claims and detailed description are attached.*

JP Search Report of Appln. No. 2013-012014 dated Sep. 5, 2014.

* cited by examiner

*Primary Examiner* — Peter DungBa Vo

*Assistant Examiner* — John S Lowe

(74) *Attorney, Agent, or Firm* — Fitch, Even, Tabin & Flannery, LLP

(57) ABSTRACT

For aging deformation of a reaction vessel used for production of titanium sponge by the Kroll method, the deformation of the reaction vessel can be corrected to a desired deformation. The apparatus for correcting the deformation corrects by being inserted inside of the cylindrical deformation of the reaction vessel, the apparatus has multiple cylinder arms radially extendable to a circumference, a deformation-correcting head arranged on a top part of the cylinder arm, a hydraulic power unit connected to the cylinder arm and driving the deformation-correcting head, a detecting means for the stroke of the deformation-correcting head, and a measuring means for the pressing force against the reaction vessel. Furthermore, the method for correcting the deformation of the reaction vessel using the apparatus has a step of pressing the reaction vessel while adjusting stroke of the deformation-correcting head depending on an amount of deformation of the reaction vessel.

3 Claims, 2 Drawing Sheets

APPARATUS FOR CORRECTING DEFORMATION OF REACTION VESSEL AND METHOD FOR CORRECTING DEFORMATION THEREFOR

TECHNICAL FIELD

The present invention relates to an apparatus for correcting the deformation of a reaction vessel for titanium sponge and a method for correcting the deformation of a reaction vessel using this apparatus, and in particular, relates to an apparatus and to a method in which deformation of a reaction container can be effectively corrected.

BACKGROUND ART

Titanium sponge is produced by the Kroll process, in which titanium tetrachloride is fed on a surface of molten magnesium bath preliminarily charged in a reaction vessel made of stainless steel, thereby being reduced to titanium by the molten magnesium. By bringing this titanium sponge into a vacuum separation process maintained at high temperature and reduced pressure, a highly pure titanium sponge is obtained with few magnesium chloride and magnesium metal.

Since the reduction process and vacuum separation process mentioned above are performed at a high temperature such as in a range of 900 to 1000° C., accompanied by repeatedly processing reaction batches, the reaction container tends to become gradually deformed.

In the deformation of the reaction vessel, the reaction vessel becomes deformed so that a top part of the reaction vessel comes to have "necking" (condition of increasing in length along a vertical direction and decreasing in an inner diameter) in many cases. When this deformation is promoted, the titanium sponge that is generated in the reaction vessel cannot be extracted from the reaction vessel, which is undesirable.

Therefore, it has been conducted to correct the deformation of a reaction vessel when deformation of the reaction vessel is within a permitted limit (See Japanese Unexamined Patent Application Publication No. Hei05 (1997)-212443).

In the correcting process, the deformation mentioned above, a cylinder arm equipped on a deformation-correcting apparatus that is inserted in a reaction vessel is expanded while maintaining a high temperature so as to press the reaction vessel, whereby effectively correcting the deformation of the necking deformation generated in the reaction vessel wall.

However, since the deformation-correcting operation is performed at a high temperature such as in a range from 700 to 800° C., there are problems in that it takes time and uses large amounts of electricity to heat the reaction vessel up to that temperature.

Furthermore, since the deformation-correcting apparatus itself is also exposed in a high temperature environment, a countermeasure of a heat shield and heat resistance may be necessary, and there may be cases causing problems in handling because of the heavy weight of the apparatus itself. Thus, improvement is required.

Furthermore, before starting the deformation-correcting operation, it is necessary that the deformed condition in the reaction vessel be understood in advance. From the viewpoint of operation efficiency including the operation of measuring the deformation, there is room for improvement.

In addition, it is not well-understood to what extent correcting of the deformation is appropriate in a reaction vessel that is deformed, and there are cases in which cracking of the reaction vessel wall occurs during or after deformation-correcting operation due to pressing by the deformation-correcting apparatus. Thus, improvement is required.

As explained above, an apparatus and a method for correcting the deformation thereof are required, in which deformation-correcting operation on the reaction vessel for production of titanium sponge having serious deformation can be effectively promoted.

SUMMARY OF THE INVENTION

An object of the present invention is to provide a preferable apparatus and method for correcting deformation that can solve the above-mentioned problems during correcting of the deformation of a reaction vessel used in production of titanium sponge by the Kroll process.

In view of these circumstances, the inventors have researched the problems mentioned above and have found that a deformed part of the reaction vessel can be efficiently corrected in deformation without generating cracking by a deformation-correcting apparatus for reaction vessel used for production of titanium sponge in which equipment for detecting displacement stroke of a deformation-correcting head arranged at the deformation-correcting apparatus and detecting stress for holding the stroke is arranged, and have thereby completed the present invention.

In addition, the inventors have found that the condition of deformation of the wall surface in the reaction vessel can be easily known by also arranging equipment for measuring a distance between the inner wall surface of the reaction vessel and the deformation-correcting apparatus, in addition to the deformation-correcting apparatus.

Furthermore, the inventors have found that the deformation-correcting operation that was conventionally performed at a high temperature can be performed at room temperature by improving the capacity of the cylinder that is extendable to a direction of an inner surface of the reaction vessel, and have thereby completed the present invention.

That is, an apparatus for correcting the deformation of the present invention is an apparatus for correcting the deformation of a reaction vessel to correct deformation of the reaction vessel by being inserted inside of the cylindrical deformation of the reaction vessel, and the apparatus has multiple cylinder arms radially extendable to a circumference, a deformation-correcting head arranged on top part of the cylinder arm, a hydraulic power unit connected to the cylinder arm and driving the deformation-correcting head, a detecting means for the stroke of the deformation-correcting head, and a measuring means for pressing force against the reaction vessel.

In the present invention, it is desirable that the apparatus further has a jig for supporting entirely the deformation-correcting apparatus, and a damper is connected to the jig.

In the present invention, it is desirable that the apparatus further have a data transmitting means for transmitting a measured value by the detecting means and the measuring means to a recording means that is arranged outside of the reaction vessel.

Furthermore, a method for correcting the deformation of a reaction vessel of the present invention is a method for correcting the deformation for a reaction vessel to correct deformation of the reaction vessel by inserting an apparatus for correcting the deformation inside the cylindrical deformation of the reaction vessel, the apparatus for correcting the deformation has multiple cylinder arms radially extendable to a circumference, a deformation-correcting head arranged on top part of the cylinder arm, a hydraulic power unit connected to the cylinder atm and driving the deformation-correcting head, a detecting means for the stroke of the deformation-correcting head, and a measuring means for pressing force against the reaction vessel, and the method for correcting the deformation has a step of pressing the reaction vessel while adjusting a stroke of the deformation-correcting head based on an amount of deformation of the reaction vessel.

In the present invention, it is desirable that an amount of extending of the cylinder arm be adjusted so that stress applied on the cylinder arm does not exceed the maximal deformation load of the reaction vessel.

In the present invention, it is desirable that the deformation-correcting apparatus further have a sensor measuring an amount of deformation in a radial direction of the inner surface of the reaction vessel, and a value measured by the sensor is transmitted to a computer arranged in a control room by a communication, and the measured value is recorded in a recording means arranged in the computer.

It is desirable that an amount to be corrected of the entire reaction vessel be calculated by the computer based on information of deformation of the reaction vessel recorded in the recording means, and the entirety of the reaction vessel be corrected based on the amount to be corrected.

According to the present invention, a reaction vessel that has been deformed during reduction process of titanium tetrachloride can be effectively corrected in deformation.

EXPLANATION OF REFERENCE NUMERALS

M . . . Deformation-correcting apparatus,
1 . . . Deformation-correcting apparatus body,
2 . . . Deformation-correcting head,
3 . . . Cylinder arm,
4 . . . Stroke detector,
5 . . . Damper,
6 . . . Displacement measuring device,
7 . . . Data transmitting device,
8 . . . Reaction vessel (wall),
8*a* . . . Reaction vessel wall before correcting the deformation,
8*b* . . . Reaction vessel wall after correcting the deformation,
10 . . . Elevating device.

BEST MODE FOR CARRYING OUT THE INVENTION

The best embodiments of the present invention are explained as follows with reference to the drawings.

Figure 1:
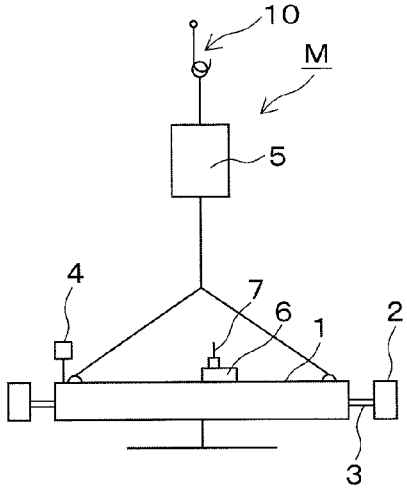
FIG. 1 is a side view showing the deformation-correcting apparatus of a reaction vessel of the present invention.
Figure 2:
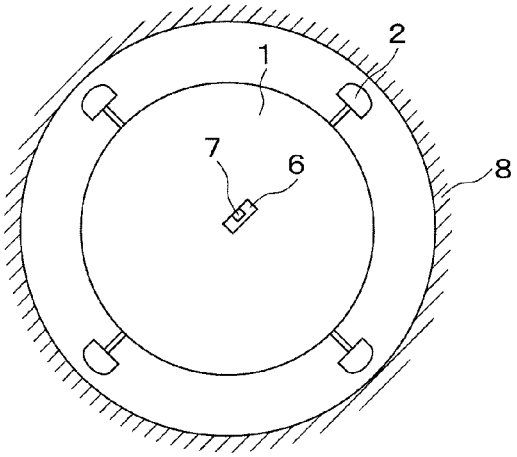
FIG. 2 is a plan view showing a condition in which the deformation-correcting apparatus for a reaction vessel of the present invention is inserted in a reaction vessel.
Figure 3:
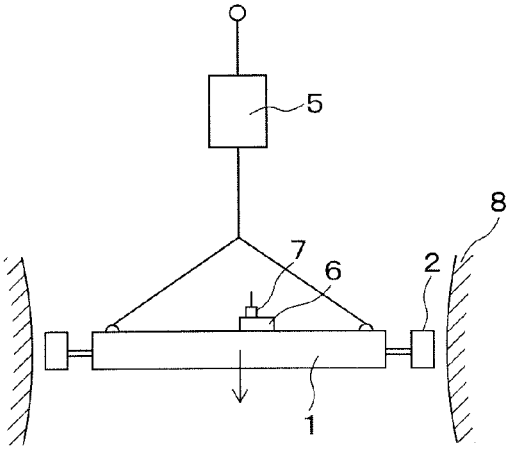
FIG. 3 is a side view showing a condition in which the deformation-correcting apparatus for a reaction vessel of the present invention is inserted in a reaction vessel.

FIG. 1 shows a desirable construction of an apparatus according to the present invention. FIGS. 2 and 3 show a situation in which the apparatus is inserted in the reaction vessel. The deformation-correcting apparatus M of the present invention is constructed by a deformation-correcting apparatus body 1, deformation-correcting heads 2, cylinder arms 3, a stroke detecting device 4, damper 5, a displacement measuring device 6, and a data transmitting device 7. The figure shows a situation in which the entirety of the apparatus is hung on a hook of an elevating device 10.

The deformation-correcting apparatus M that is hung is inserted into a reaction vessel 8 that is badly deformed by elevating operation of the elevating device 10. After the deformation-correcting apparatus M is arranged at a vertical position where correcting the deformation is needed, the cylinder arms 3 arranged in the deformation-correcting apparatus M are expanded, thereby enabling the correcting of the deformation of the deformed portion of the reaction vessel 8 where the wall is deformed shrinking in a direction to the inside by pressing by the deformation-correcting heads 2.

The stroke detecting device 4 for the extendable cylinder arms 3 is arranged on the deformation-correcting apparatus M of the present invention, and the deformed portion of the reaction vessel 8 can be corrected in deformation until an amount of displacement that was predetermined is in an appropriate range.

In addition, the damper 5 that is arranged on the deformation-correcting apparatus M of the reaction vessel 8 of the present invention is connected to the elevating device 10. The damper 5 absorbs shock that occurs when the deformation-correcting apparatus body 1 oscillates upward and downward during deformation-correcting operation.

As the displacement measuring device 6 arranged on the deformation-correcting apparatus body 1, an apparatus can be employed that has a conventional sensor which measures a distance to an object (in this case, reaction vessel wall 8) and surface condition of the object by emitting sound waves or light and by sensing that which is reflected.

The data transmitting device 7 which is arranged on the displacement measuring device 6 is a device to transmit a value measured by the displacement measuring device 6 to the outside of the reaction vessel by a communication means. The communication mentioned here can be performed by a wireless or a wired means.

Next, a desirable embodiment in a case in which the displacement measuring device 6 for the inner wall surface of the reaction vessel 8 is used is explained as follows. In this embodiment, a process for measuring an amount of deformation of the reaction vessel 8 and a process for correcting the deformation of the reaction vessel 8 are separately explained.

1) Process for Measuring Amount of Deformation of Reaction Vessel

It is desirable that the displacement measuring device 6 of the inner wall surface of the reaction vessel 8 be arranged on the deformation-correcting apparatus body 1 of the reaction vessel of the present invention. By the displacement measuring device 6 arranged on the deformation-correcting apparatus body 1, a convex and concave portion formed on the inner wall surface of the reaction vessel can be measured by inserting the deformation-correcting apparatus M into the reaction vessel.

The data transmitting device 7 can be arranged on the displacement measuring device 6. By arranging the data transmitting device 7, data that is measured at the site can be transmitted to a server provided in a control room in real time, for example.

2) Process for Correcting Deformation of Reaction Vessel

In the correcting process of the reaction vessel 8 of the present invention, it is desirable that an amount of displacement of the reaction vessel which is deformed be automatically calculated based on data which is measured during the process for measuring amount of deformation of the reaction vessel 8, and then, a target amount to be corrected in the reaction vessel is calculated.

Figure 4:
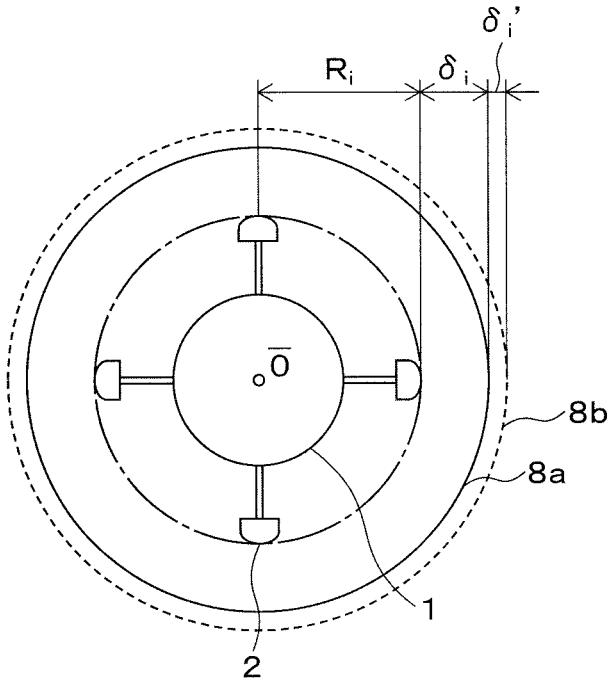
FIG. 4 is a plan view showing a condition in which the deformation-correcting apparatus for a reaction vessel of the present invention is inserted in a reaction vessel.

A practical content of the measured value mentioned above is explained with reference to FIG. 4. FIG. 4 conceptually shows a plan view of a situation in a case in which the deformation-correcting apparatus M of the reaction vessel is positioning at a certain vertical position in the reaction vessel 8.

Here, the distance from surface of the deformation-correcting head 2 arranged on the deformation-correcting apparatus M of the reaction vessel to center of the deformation-correcting apparatus M is defined as the distance to inner surface of the vessel wall 8*a* which is before deformation-correcting is defined as $\delta_i$, and the distance to the inner surface of the vessel wall 8*b* which is after correcting the deformation is defined as $\delta_i'$. It should be noted that i is selected from 1, 2, 3 and 4 since the cylinder arms 3 and the deformation-correcting heads 2 are set at four positions in FIG. 4. However, in the present invention, the number of the cylinder arm and the deformation-correcting head is not limited to 4, and the number can be varied freely. In such a case, the value of i selected is also varied.

In the condition shown in FIG. 4, an average radius $R_a$ of the reaction vessel wall 8*a* before correcting the deformation can be shown as follows.

$$R_a=\Sigma(R_i+\delta_i)/4\ (mm)$$

Furthermore, an average radius $R_a'$ of the reaction vessel wall 8*b* after correcting the deformation can be shown as follows.

$$R_a'=\Sigma(R_i+\delta_i+\delta_i')/4\ (mm)$$

Therefore, a deformation ($\pi$) that occurred in the reaction vessel during the correcting of the deformation of the reaction vessel 8 is shown as follows.

$$\epsilon=\pi\cdot(R_a-R_a')/\pi\cdot R_a$$

Therefore, a stress $\sigma$ that is applied to the entirety of the reaction vessel can be shown by the c and the Young's modulus (YK) as follows.

$$\sigma=E\cdot\epsilon$$

Here, E is a coefficient called the Young's modulus. Therefore, when the Young's modulus and the deformation applied during correcting the deformation are determined, the stress $\sigma$ applied to the reaction vessel can be also determined. Therefore, the $\sigma$ should be controlled so as not to exceed the breaking stress of the material of the reaction vessel.

By performing the information process mentioned above, breaking of the deformation-corrected part due to over-correcting the deformation can be efficiently controlled.

It is desirable that the amount to be deformation-corrected which is calculated as mentioned above, be maintained as a function of height of the reaction vessel. By maintaining this function, by using the above amount to be corrected as an input value, the amount of extending (amount of displacement) of the cylinder arms 3 arranged on the deformation-correcting apparatus of the present invention can be controlled.

Furthermore, by elevating the hook of the elevating device 10 to which the deformation-correcting apparatus M of the present invention is hung upward and downward, a vertical position of the deformation-correcting apparatus can be determined. At that time, a target value to be deformation-corrected at the vertical position is calculated by the function that is stored in the server, the cylinder arms 3 can be extended until the target value, and as a result, an appropriate amount of correcting of the deformation can be maintained.

By the abovementioned operation, concave and convex portions on the wall of the reaction vessel can be deformation-corrected efficiently and accurately.

EXAMPLES

Next, the present invention is further explained in detail by way of Examples and Comparative Examples.

Devices and conditions of the present invention are as follows.

1. Condition of Devices

1) Reaction Vessel

Deformation: inner diameter 1900 mm× height 5000 mm

Material: stainless steel

2) Apparatus for Correcting Deformation of Reaction Vessel

The apparatus shown in FIG. 1 was used. Specifications of sensor equipped in the apparatus are as follows.

Stroke detecting device of deformation-correcting head: mechanical stroke length detecting device Distance measuring device from the reaction vessel: optical sensor Device to know vertical position of the deformation-correcting apparatus: optical sensor 3) Manual Correcting of Deformation The cylinder arms that were arranged on the deformation-correcting apparatus that was inserted into the reaction vessel were extended until a target stroke.

4) Automatic Correcting of Deformation

Measured data processing and automatic deformation-correcting apparatus

Step 1: Signal was converted to a digital data by an AD converter, and the data was transmitted to a server arranged in a control room by a wireless communicating means.

Step 2: The data was verified with a profile of the reaction vessel wall held in the server, a required stroke length of the cylinder necessary to restore the deformation of the reaction vessel wall was calculated as a function of vertical position of the reaction vessel, and the result was stored in the server.

Step 3: Amount to be extended of the reaction vessel wall was calculated based on the position information in vertical direction of the deformation-correcting apparatus inserted in the reaction vessel, the stroke of the cylinder was adjusted to be in a range not to exceed the calculated value, thereby correcting the deformation of the reaction vessel.

2. Test Method

Using the apparatus construction mentioned above, the deformation-correcting operation of the reaction vessel was performed.

Example 1

Condition of a reaction vessel in which an inner wall was deformed was measured manually, and deformation profile in a vertical direction was made. The deformation-correcting apparatus of the present invention was inserted from the upper part of the reaction vessel and descends to a certain vertical position of the reaction vessel while being hung, based on the profile.

Then, the cylinders arranged on the apparatus were extended in a specific length. At this time the cylinders were extended until the specific stroke while observing a display of the stroke detecting device 4 arranged on the apparatus.

The above-mentioned operation was performed step by step along a vertical direction while descending, and the entirety from the top part to the bottom part of the reaction vessel could be corrected in deformation in a cold condition. After correcting of the deformation was completed, the vessel was sealed and pressed until a specific 1 atm so as to confirm there was no leakage due to cracking, and the vessel was used as a production vessel for titanium sponge.

Comparative Example 1

Except that the deformation-correcting operation was performed while the reaction vessel was heated to 1000° C., the deformation-correcting operation of the reaction vessel was performed in a manner similar to that in Example 1. As a result, the time required for correcting the deformation was about 66% longer than Example in which correcting the deformation was performed in a cold condition. Furthermore, time was necessary to heat the reaction vessel before correcting the deformation, which time was about 3 to 4 times in total compared to Example 1.

Example 2

In Example 1, measuring of deformation of the reaction vessel wall was performed using a vessel wall displacement measuring device arranged on the deformation-correcting apparatus M of the present invention by measuring the deformation profile in a vertical direction of the reaction vessel inner wall and by transmitting the measured value to a server in a control room.

Then, the deformation-correcting apparatus M was moved near the top part in the reaction vessel. Height of the deformation-correcting apparatus M halting in the reaction vessel was automatically measured by the sensor, and the signal was transmitted to the server. An appropriate amount to be corrected at the position was calculated and fed back to the deformation-correcting apparatus, and an amount to be extended of the cylinders arranged on the deformation-correcting apparatus was automatically controlled so as to perform correcting of the deformation of the reaction vessel.

Comparative Example 2

In Example 1, the stroke displacement of the deformation-correcting apparatus arranged in the reaction vessel was adjusted while visually observing, and the deformation-correcting operation was performed. As a result, a time of 1.5 times longer was necessary compared to Example 1 in which the deformation-correcting operation was performed automatically. Furthermore, leakage check was performed after completing the deformation-correcting operation, and gas leakage was detected from a part of the deformation-corrected portion of the reaction vessel. The location where gas leaked was checked in detail, and a linear crack was observed. In order to use the reaction vessel in a production process for titanium sponge, it was necessary that the area at which the gas leaked be repaired.

The present invention is appropriately useful in deformation-correcting operation of a reaction vessel used in the production of titanium sponge.

What is claimed is:

1. A method for correcting deformation of a cylindrical reaction vessel to correct deformation of the cylindrical reaction vessel by inserting an apparatus for correcting the deformation inside of the cylindrical reaction vessel, the apparatus for correcting the deformation, comprising:

multiple cylinder arms radially extendable to a circumference, a plurality of deformation-correcting heads, each of the plurality of deformation-correcting heads being arranged on an outer end of each of the cylinder arms, a hydraulic power unit connected to the cylinder arms and driving the deformation-correcting heads, a stroke detector for detecting a stroke of the deformation-correcting heads, an elevating device for supporting the cylinder arms and the deformation-correcting heads inside of the cylindrical reaction vessel, and a damper connecting the elevating device with the cylinder arms and the deformation-correcting heads to absorb shock when the cylinder arms and the deformation-correcting heads oscillate upward and downward during a deformation-correcting operation, the method for correcting the deformation comprising:

a step of inserting the apparatus for correcting the deformation into the cylindrical reaction vessel in a vertical direction by operating the elevating device, and a step of pressing the reaction vessel while adjusting a stroke of the deformation-correcting heads based on an amount of deformation of the cylindrical reaction vessel, wherein the apparatus for correcting deformation further comprises a sensor measuring an amount of deformation in a radial direction of an inner surface of the cylindrical reaction vessel, a measured value measured by the sensor is transmitted to a computer arranged in a control room by a communication, and the measured value is recorded in a recording device arranged in the computer.

2. The method for correcting the deformation of a cylindrical reaction vessel according to claim 1, wherein an amount to be deformation-corrected of an entirety of the reaction vessel is calculated by the computer based on information of deformation of the cylindrical reaction vessel recorded in the recording device, and the entirety of the reaction vessel is deformation-corrected based on the amount to be deformation corrected.

3. A method for correcting the deformation of the cylindrical reaction vessel by inserting an apparatus for correcting the deformation inside of the cylindrical reaction vessel, the apparatus for correcting the deformation, comprising:

multiple cylinder arms radially extendable to a circumference, a plurality of deformation-correcting heads, each of the plurality of deformation-correcting heads being arranged on an outer end of each of the cylinder arms, a hydraulic power unit connected to the cylinder arms and driving the deformation-correcting heads, a stroke detector for detecting a stroke of the deformation-correcting heads, an elevating device for supporting the cylinder arms and the deformation-correcting heads inside of the cylindrical reaction vessel, and a damper connecting the elevating device with the cylinder arms and the deformation-correcting heads to absorb shock when the cylinder arms and the deformation-correcting heads oscillate upward and downward during a deformation-correcting operation the method for correcting the deformation comprising:

a step of inserting the apparatus for correcting the deformation into the cylindrical reaction vessel in a vertical direction by operating the elevating device, and a step of pressing the reaction vessel while adjusting a stroke of the deformation-correcting heads based on an amount of deformation of the cylindrical reaction vessel, wherein an amount of extending of the cylinder arms is adjusted so that stress applied on the cylinder arms does not exceed a maximal deformation load of the cylindrical reaction vessel, wherein the apparatus for correcting deformation further comprises a sensor measuring an amount of deformation in a radial direction of the inner surface of the reaction vessel, a measured value measured by the sensor is transmitted to a computer arranged in a control room by a communication, and the measured value is recorded in a recording device arranged in the computer.

* * * * *